United States Patent [19]

Cupples et al.

[11] 4,282,392

[45] Aug. 4, 1981

[54] ALPHA-OLEFIN OLIGOMER SYNTHETIC LUBRICANT

[75] Inventors: Barrett L. Cupples, Franklin Township, Westmoreland County, Pa.; William J. Heilman, Houston, Tex.

[73] Assignee: Gulf Research & Development Company, Pittsburgh, Pa.

[21] Appl. No.: 916,476

[22] Filed: Jun. 19, 1978

Related U.S. Application Data

[60] Continuation-in-part of Ser. No. 736,679, Oct. 28, 1976, abandoned, which is a division of Ser. No. 634,624, Nov. 24, 1975, Pat. No. 4,032,591.

[51] Int. Cl.[2] ..... C07C 9/14

[52] U.S. Cl. ..... 585/10; 585/78; 585/510; 585/525

[58] Field of Search ..... 260/676 R, 683.15 R, 260/683.15 A, 683.15 B, 683.15 C; 252/59

[56] References Cited

U.S. PATENT DOCUMENTS

| | | | |
|---|---|---|---|
| 3,322,848 | 5/1967 | Garwood et al. | 260/683.15 R |
| 3,382,291 | 5/1968 | Brennan | 260/683.15 B |
| 3,725,498 | 4/1973 | Brennan | 260/683.15 B |
| 3,763,244 | 10/1973 | Shubkin | 260/676 R |
| 3,842,134 | 10/1974 | Pratt | 260/683.15 B |
| 3,947,507 | 3/1976 | Isa et al. | 260/683.15 R |
| 3,985,821 | 10/1976 | Girotti et al. | 260/676 R |

*Primary Examiner*—C. Davis

*Attorney, Agent, or Firm*—Deane E. Keith; Forrest D. Stine; Donald L. Rose

[57] ABSTRACT

An alpha-olefin oligomer synthetic lubricant having an improved viscosity-volatility relationship is prepared from an alpha-olefin such as 1-decene.

6 Claims, No Drawings

ALPHA-OLEFIN OLIGOMER SYNTHETIC LUBRICANT

This application is a continuation-in-part of Ser. No. 736,679, filed Oct. 28, 1976, and now abandoned, which is a division of Ser. No. 634,624, filed Nov. 24, 1975, now Patent No. 4,032,591.

FIELD OF THE INVENTION

This invention relates to the preparation of a hydrogenated alpha-olefin oligomer lubricant from an alpha-olefin, such as 1-decene, and more particularly it relates to an alphaolefin oligomer product comprising trimer, tetramer and pentamer having an improved viscosity-volatility relationship and a higher Viscosity Index.

DESCRIPTION OF THE PRIOR ART

U.S. Pat. No. 3,149,178 describes the preparation of a synthetic lubricant by the batch polymerization of alphaolefins, including 1-decene, in a reactor using boron trifluoride together with a promoter such as boron trifluoride.decanol complex to produce dimer, trimer and a residual polymer fraction and the hydrogenation thereof.

U.S. Pat. Nos. 3,763,244 and 3,780,128 describe the batch oligomerization of 1-olefins, such as 1-decene, in a reaction vessel using an alcohol or water co-catalyst and boron trifluoride bubbled through the reaction liquid to provide a molar excess of the boron trifluoride. A product mixture of dimer, trimer, tetramer and higher oligomers is hydrogenated.

U.S. Pat. No. 3,842,134 describes a substantial increase in the trimer fraction obtained by the oligomerization of certain alpha-olefins, including 1-decene, by the use of a complex of aluminum chloride and a nitroalkane instead of the conventional anhydrous aluminum chloride catalyst.

SUMMARY OF THE INVENTION

We have discovered that an oligomer product useful as a synthetic lubricant comprising the trimer, tetramer and pentamer of an alpha-olefin can be prepared having an improved viscosity-volatility relationship and improved viscosity index. Thus, we have found that a mixture of oligomer fractions of a specified viscosity for lubrication can be prepared with a much higher proportion of the higher molecular weight fractions and correspondingly lower volatility than exhibited by conventional oligomer mixtures prepared from the same alpha-olefin monomer and having the same viscosity. Or expressed otherwise, we have found that we can prepare a mixture of oligomer fractions with the same proportion of the several oligomer fractions and therefore with the same volatility but possessing a much lower viscosity than a conventional oligomer product prepared from the same alpha-olefin monomer.

Oligomers of certain 1-olefins, particularly 1-decene and mixtures of 1-decene with 1-octene and/or 1-dodecene are highly useful as base fluids for preparing lubricants, hydraulic fluids, transmission fluids, transformer fluids, and the like, generically designated as functional fluids, by the use of appropriate additives. Alha-olefin oligomers can, in some instances, also be used as functional fluids without the use of property modifying additives. Each functional fluid product and generally the base fluid from which it is prepared must conform with established viscosity and volatility specifications.

These alpha-olefin oligomer products are conventionally prepared by the cationic polymerization of the 1-olefin using a Friedel-Crafts catalyst. The oligomer product is then hydrogenated in a conventional manner to stabilize the oligomer against oxidation and degradation. The cationic reaction mechanism is well known and is reported in the literature.

The cationic polymerization of an alpha-olefin such as 1-decene using boron trifluoride and a co-catalyst which complexes with boron trifluoride involves a reaction of the double bonds of the alpha-olefin molecule forming larger oligomer molecules with two or more relatively straight chain relicts from the 1-decene. For example, it has been reported that the compound 9-methyl-11-n-octyl heneicosane is a typical molecule in a commercial 1-decene oligomer synthetic lubricant. Using conventional reaction conditions, this polymerization reaction conveniently prepares an oligomer mixture including the dimer, trimer, tetramer, and pentamer having straight chain branches of relatively long carbon length, as described. The dimer is removed for separate use to avoid volatilization loss from functional fluids comprising the higher oligomers. Minor amounts of oligomers higher than the pentamer, such as the hexamer, may be present but since their analysis and separation from the pentamer is difficult, they, if present, are generally reported as pentamer.

The composition of the oligomer mixture that is obtained from the oligomerization reaction is generally much too rich in the tetramer and pentamer fractions to meet the viscosity specifications for a desired functional fluid product. This usually requires the separation of the oligomer composition into one or more product fractions comprising the trimer or a mixture of oligomers, rich or predominating in the trimer, depending on the particular need. And most significantly, this generally results in a significant unusable surplus of the higher oligomer fractions to be discarded, namely, the tetramer and pentamer fractions as reported in U.S. Pat. No. 3,997,621.

The alpha-olefin oligomer functional fluids such as functional fluids made by the oligomerization of 1-decene are especially adapted for use in exceptionally rigorous conditions. This includes general use in an arctic environment or special use as a hydraulic fluid and engine lubricant in jet aircraft which involves both very high and very low temperatures as well as subatmospheric pressure. A particular problem relates to the need to meet established product specifications regarding both viscosity and volatility for these rigorous applications. Thus, such specifications require a relatively low subzero (−40° F.) viscosity which can readily be attained by reducing the average molecular weight of the oligomer product. But this reduction in the average molecular weight of the oligomer mixture requires a much higher proportion of trimer which is more difficult to obtain in high yield in the oligomerization reaction. And furthermore, this higher proportion of trimer in the product mixture undesirably increases the volatility of the functional fluid at the high operating temperatures.

We have discovered that the viscosity-volatility properties of the finished lubricant can also be varied in the desired direction by changing the structure of the molecules within each specific oligomer fraction. Since each individual molecular structure in a 1-decene oligomer fraction possesses its own particular viscosity and volatility, the viscosity-volatility properties of an oligomer fraction, such as the trimer of 1-decene, are the net result of the properties of all of the different molecular structures within the oligomer fraction. We have found that a significant skeletal rearrangement can be effected by a special hydrogenation procedure to form methyl, ethyl, and propyl groups on the straight chain portions of the oligomer molecules thereby effecting a significant change in the isomeric composition and properties of each fraction.

We have discovered that this significant change in the isomeric comosition within the oligomer fractions effected by the skeletal rearrangement surprisingly results in a significant improvement in the viscosity-volatility properties and viscosity indexes of the oligomer fractions. That is, we have found that we can prepare a mixture of the trimer, tetramer and pentamer of 1-decene having a much higher proportion of the tetramer and pentamer than possible with conventional mixtures of 1-decene oligomer fractions to produce the same 210° F. viscosity. As a result, a much greater proportion, or even all, of the crude oligomer product can be utilized than heretofore possible by using conventional procedures.

Prior to our invention, the 1-decene and other alpha-olefin oligomers have been prepared without any attention directed to the control of the isomeric structures within the oligomer fractions. Instead, as pointed out above, control of properties has been effected by controlling the relative proportion of each oligomer fraction in the product, which generally involves the use of more trimer than is produced in conventional oligomerization procedures and the wasting of higher oligomers. Heretofore, primary attention toward increasing the economy of the overall alpha-olefin oligomer functional fluid operations has been for process variations directed to increasing the proportion of the trimer in the oligomerization process.

The trimer of 1-decene can theoretically occur in over four billion possible structural isomers according to Richter, *Textbook of Organic Chemistry,* 1943, each with its own individual physical properties. Individual compounds are very difficult to isolate from a mixture of the isomers and for this reason most of these isomers have never been identified and characterized. Since with rare exception the individual isomers are not available in relatively pure form, it is not possible to prepare an oligomer fraction having optimum properties by mixing together those various structural isomers that possess the desired properties. Thus, it is not possible to prepare a thirty-carbon fraction having desirable properties from various individual isomers of triacontane.

The isomerization of the carbon structure of hydrocarbons is known to be very difficult. Since the hydrogenation of aliphatic double bonds is a simple, exothermic reaction, it would not be expected that skeletal rearrangement would occur during a conventional, double bond hydrogenation procedure. Surprisingly, we have discovered that substantial skeletal rearrangement can be obtained with the formation of property improving methyl, ethyl and propyl structures in the individual molecules of the oligomer fractions by utilizing a special procedure for accomplishing the hydrogenation. It is surprising that this small chain branching, superimposed on the long chain branches of the oligomer, would produce the substantial improvement in the viscosity-volatility relationship and viscosity index which we have observed. It is also surprising that we are able to accomplish this small chain branching by skeletal rearrangement without also isomerizing the long branches to a more linear structure or without cracking the oligomer.

In our hydrogenation procedure, liquid oligomer at an elevated temperature is flowed or trickled over the surface of particles or pellets of the catalyst packed into a column in the presence of hydrogen at elevated pressure. This procedure involves an exceptionally intimate contact of the total liquid oligomer with the catalyst for a substantial period of time, since substantially all of the oligomer is present as a thin liquid film on the catalyst as the oligomer passes through the column. In this trickle-through procedure the great bulk of liquid oligomer is located on the catalyst surface with hydrogen gas predominating in the interstitial spaces between the pellets. Therefore, there is no large bulk of the liquid oligomer far removed from catalyst surface at any time during the hydrogenation reaction.

The hydrogenation is preferably carried out at an elevated temperature of between about 100° C. to about 300° C. and preferably between about 150° C. and about 220° C., and a hydrogen pressure between about 200 psi. and about 2,000 psi., or higher, and preferably between about 300 psi., and about 1,000 psi. These temperature ranges refer to the average temperature in the hottest zone of the catalyst bed as determined by thermocouple probes in the bed. We believe that there may be many localized hot spots in the catalyst pores substantially higher in temperature than the above range where substantial reaction is taking place and which may be a source of the improved results of our procedure. The upper pressure is limited by the cost of high pressure operation. We have found that the amount of skeletal isomerization to methyl, ethyl and propyl groups tends to increase as the hydrogenation temperature and/or hydrogen pressure increases in the trickle-through hydrogenation procedure described herein.

The procedure described herein is particularly suitable in the preparation and hydrogenation of mixtures of the trimer, tetramer and pentamer of alpha-olefins selected from 1-octene, 1-decene and 1-dodecene and mixtures thereof. The preferred alpha-olefin monomer is 1-decene with up to 50 mol percent 1-octene or 1-dodecene or a mixture thereof and the most preferred is 1-decene itself. The terms alpha-olefin, 1-olefin, 1-decene and the like, in general and as used herein, refer to the normal or straight chain olefin.

We have found that the skeletal rearrangement procedure described herein is particularly useful in increasing the average molecular weight required to make a base fluid of a specified viscosity, which is particularly advantageous since the trimer is ordinarily difficult to prepare in high yield and therefore can be used more sparingly for any given specification. Thus, we find that by our procedure we can prepare an oligomer base fluid from 1-decene having a 210° F. (98.9° C.) viscosity of at least about 5.4 cs. and up to about 6.6 cs., preferably up to about 6.3 cs. and most preferably up to about 6.0 cs., and having a maximum of about two percent dimer, a maximum trimer to tetramer weight ratio of about 1:1 and at least about 15 weight percent pentamer and higher. This oligomer base fluid composition is further characterized as having a −40° F. viscosity of at least about 5,500 cs., more generally at least about 6,500 cs. and the trimer fraction is characterized as having a maximum −40° F. viscosity of about 2,250 cs. and preferably a maximum of about 2,100 cs. These viscosity specifications all refer to the hydrogenated product.

This is significant because hydrogenation increases the viscosity of the product. For example, U.S. Pat. No. 3,997,621 states that kinematic viscosity increases nearly uniformly by about 30 percent on hydrogenation.

As stated, the oligomer product which is skeletally isomerized by our process herein is prepared by cationic polymerization using a suitable Friedel-Crafts catalyst. We prefer to use uncomplexed boron trifluoride in combination with a boron trifluoride complex of a suitable promoter or co-catalyst which forms a coordination compound with boron trifluoride that is catalytically active for the oligomerization reaction. Suitable co-catalysts are well known in the art and include the aliphatic alcohols having from one to about 10 carbon atoms, water, carboxylic acids and alkyl ethers having up to about 10 carbon atoms, and the like. The preferred oligomerization procedure utilizes the boron trifluoride complex together with free boron trifluoride for enhanced rate of reaction.

The hydrogenation is carried out in a column packed to a suitable height with a solid hydrogenation catalyst in uniformly shaped particle, granule or pellet form, preferably averaging between about 1.5 mm. and about 6 mm. in diameter, most preferably between about 3 mm. and about 4 mm. to insure sufficient porosity in the catalyst bed and suitable catalyst surface area. The catalyst can be any metal suitable for olefin hydrogenation such as nickel, platinum, palladium, copper, Raney nickel and the like on a suitable support such as alumina, kieselguhr, charcoal and the like, and having a suitable particle size within the specified range. The flow-through hydrogenation reactor can be pressured with hydrogen to a suitable pressure but we find that temperature control of the exothermic hydrogenation reaction can be conveniently accomplished, in part, by the flow of hydrogen through the catalyst bed at the desired pressure. Although conventional hydrogenation procedures may introduce some methyl, ethyl and propyl groups into the oligomer structure by skeletal rearrangement, we have discovered that our method substantially increases the amount of the skeletal rearrangement. We have further discovered that this substantial increase in the methyl, ethyl and propyl branching results in an improved viscosity-volatility relationship and improved Viscosity Index.

DESCRIPTION OF PREFERRED EMBODIMENTS

The viscosity measurements that are used herein are the kinematic viscosities in centistokes (cs.) as determined by ASTM D445. The viscosity indexes were determined by ASTM D2270 and the various evaporation losses were determined by ASTM D972. The various oligomer distributions were determined by gas chromatography. Because of the very small amount of hexamer, if any, present in the pentamer fraction, it was regarded as pentamer in making the calculations of average molecular weight.

EXAMPLES 1-3

The oligomerization of 1-decene was carried out at a temperature of 50° C. using boron trifluoride at a pressure of 50 psig. in Examples 1 and 3 and 100 psig. in Example 2 with n-butanol as the co-catalyst. The oligomer was hydrogenated by a conventional hydrogenation procedure by slurrying the product with a powdered nickel on kieselguhr hydrogenation catalyst at a hydrogen pressure of 300 psig. and a temperature of 100° C. A light fraction was flashed off of the hydrogenated product to produce a residue having a 210° F. viscosity suitable as a motor oil base fluid. The product analyses are set out in Table I together with a commercially available 1-decene oligomer lubricant.

TABLE I

| Example | 1 | 2 | 3 | |
|---|---|---|---|---|
| Viscosity, cs. | | | | |
| −40° F. | — | — | — | 7830 |
| 0° F. | — | — | — | 833 |
| 100° F. | 26.8 | 31.3 | 32.4 | 32.8 |
| 210° F. | 5.17 | 5.67 | 5.84 | 5.85 |
| Viscosity Index | 137 | 134 | 136 | 134 |
| Evaporation Loss, wt. % | — | — | — | 6.8 |
| Oligomer, wt. % | | | | |
| $C_{20}$ | — | — | — | 0.3 |
| $C_{30}$ | 66.6 | 56.6 | 54.4 | 54.1 |
| $C_{40}$ | 25.0 | 30.0 | 29.6 | 33.4 |
| $C_{50}$ | 8.4 | 13.4 | 16.0 | 12.2 |
| Av. Mol. wt. | 467 | 484 | 488 | 486 |
| $C_{30}/C_{40}$ ratio | 2.67 | 1.89 | 1.84 | 1.62 |

EXAMPLE 4

A purified stream of 1-decene was oligomerized in the two reactor process described in U.S. Pat. No. 4,045,507 at a temperature of 40° C. using boron trifluoride under 50 psi. (3.52 Kg/cm$^2$) and n-butanol as the co-catalyst. The product was an oligomer mixture comprising 20.2 percent monomer, 9.4 percent dimer, 44.7 percent trimer, 19.2 percent tetramer and 6.5 percent pentamer.

This oligomer product was slowly fed into the top of a first hydrogenation unit containing $\frac{1}{8}$ inch (3.2 mm.) diameter nickel on kieselguhr (Harshaw Ni-0104-$\frac{1}{8}$T) catalyst and was allowed to trickle or flow along the surface of the catalyst pellets. This reactor had an internal diameter of $7\frac{5}{8}$ inches (19.4 cm.) with the total depth of catalyst in the reactor being $78\frac{1}{2}$ inches (199 cm.) and the catalyst volume being 15.5 gal. (58.7 l.) Hydrogen gas was flowed down through this reactor at an internal reactor pressure of 335 psi (23.6 Kg/cm$^2$). The space velocity of oligomer product through the reactor was 5.5/hr.

The oligomer product was then trickled through a second hydrogenation reactor having an internal diameter of $11\frac{3}{8}$ inches (28.9 cm.) and containing the same nickel on kieselguhr catalyst. This catalyst bed had a total thickness of 234 inches (5.95 m.) and a catalyst volume of 103 gal. (390 l.). The hydrogen was also flowed down through this reactor at an internal reactor pressure of 335 psi. (23.6 Kg/cm$^2$). The space velocity of the oligomer product through this second reactor was 0.7/hr. The average temperature in the first reactor was 199° C. and it was 202° C. in the second reactor. A light fraction was flashed off from the product from the second hydrogenation unit leaving a bottoms fraction having a 210° F. (98.9° C.) viscosity of 6.03 cs. suitable as a motor oil base fluid. The analysis of this base fluid is set out in Table II.

EXAMPLES 5-11

A series of oligomer products were prepared by oligomerizing 1-decene and hydrogenating the oligomer product by the methods and general conditions described in Example 4. Motor oil base fluids were also obtained by flashing off a light fraction from the hydrogenated product. The analyses of the base fluids are set out in Table II.

TABLE II

| Example | 4 | 5 | 6 | 7 | 8 | 9 | 10 | 11 |
|---|---|---|---|---|---|---|---|---|
| Viscosity, cs. | | | | | | | | |
| −40° F. | 7560 | 6630 | 6490 | 6620 | 7330 | 7690 | 7880 | 7820 |
| 0° F. | 833 | 727 | 738 | 750 | 792 | 828 | 839 | 831 |
| 100° F. | 33.8 | 30.5 | 30.9 | 31.2 | 32.4 | 33.3 | 33.4 | 33.5 |
| 210° F. | 6.03 | 5.63 | 5.69 | 5.71 | 5.87 | 5.99 | 5.94 | 6.00 |
| Viscosity Index | 138 | 140 | 139 | 138 | 138 | 139 | 136 | 138 |
| Evap. Loss, wt. % | 4.8 | — | — | — | — | — | — | — |
| Oligomer, wt. % | | | | | | | | |
| $C_{20}$ | 1.0 | 1.4 | 2.5 | 2.2 | 1.5 | 0.6 | — | 0.3 |
| $C_{30}$ | 33.3 | 40.9 | 39.3 | 40.6 | 35.4 | 26.2 | 33.1 | 26.5 |
| $C_{40}$ | 42.3 | 40.2 | 39.3 | 41.6 | 44.6 | 55.6 | 49.2 | 53.5 |
| $C_{50}$ | 23.4 | 17.5 | 18.9 | 15.6 | 18.5 | 17.6 | 17.7 | 19.7 |
| $C_{30}/C_{40}$ ratio | 0.79 | 1.02 | 1.00 | 0.98 | 0.80 | 0.47 | 0.67 | 0.49 |
| Av. Mol. Wt. | 524 | 504 | 503 | 500 | 513 | 531 | 523 | 535 |

EXAMPLE 12

A trimer rich product was distilled off from the hydrogenated oligomer product of 1-decene made by the procedure and using the general conditions as described in Example 4. This oligomer product contained 85.3 weight percent trimer, 13.3 percent tetramer and 1.4 percent pentamer. It was distilled at a pressure of 0.2 mm. Hg. to separate the trimer according to the difference in boiling points of the different isomer components of the trimer. A series of distillation cuts were taken and the −40° F. viscosity of the even-numbered cuts, containing 100 percent trimer, was obtained. The data are set forth in Table III.

TABLE III

| Cut No. | Distilled,% | Temp., °C. | $C_{30}$, % | −40° F. Vis., cs. |
|---|---|---|---|---|
| 1 | 6.0 | 219[b] | 99.6 | — |
| 2 | 6.0 | 186 | 100 | 2059 |
| 3 | 6.1 | 186 | 100 | — |
| 4 | 6.1 | 186 | 100 | 2069 |
| 5 | 6.1 | 186 | 100 | — |
| 6 | 6.0 | 187 | 100 | 1986 |
| 7 | 5.8 | 188 | 100 | — |
| 8 | 6.2 | 188 | 100 | 1988 |
| 9 | 6.2 | 188 | 100 | — |
| 10 | 6.4 | 188 | 100 | 1869 |
| 11 | 6.4 | 189 | 100 | — |
| 12 | 5.5 | 201 | 100 | 1804 |
| 13 | 6.4 | a | 100 | — |
| 14 | 3.8 | a | 100 | 1732 |
| 15 | 1.8 | 216 | ~95 | — |
| Res. | 15.1 | | 0.9 | |
| Sum | 100.0 | | | |
| Composite | | | | 1924 |

a - vapor rate too low to measure.
b - 2.3 mm. Hg.

EXAMPLE 13

Another trimer rich product was distilled off from a different hydrogenated oligomer product of 1-decene made by the procedure and using the general conditions as described in Example 4. This oligomer product contained 89.6 weight percent trimer and 10.4 percent tetramer. It was also distilled at a reduced pressure and a series of distillation cuts was taken. The −40° F. viscosity in centistokes of the even-numbered distillation cuts is, in order from cut 2 through cut 16, 2252, 2235, 2141, 2111, 2027, 1976, 1980 and 1902 giving a composite viscosity of 2043 cs. for the trimer.

EXAMPLE 14

The dimer product was distilled off from the hydrogenated oligomer product of 1-decene made by the procedure and using the general conditions as described in Example 4. This dimer was separated into different fractions by gas chromatography. At least fifty 20-carbon isomers were readily identifiable as separate peaks in the gas chromatograph printout. The peaks of many additional isomers were believed to be submerged in the printout. Reaction probabilities for the oligomerization reaction suggest a substantial multiple of fifty isomers in the trimer, tetramer and pentamer fractions.

It is noted that the motor oil base fluid prepared from an oligomer fraction by hydrogenation according to our procedure possesses a much higher proportion of the heavier oligomers and has a significantly lower volatility and higher Viscosity Index at a similar viscosity specification than the oligomer base fluids made by conventional hydrogenation procedures. The product prepared by our procedure was analyzed for skeletal isomerization using carbon-13 nuclear magnetic resonance spectroscopy by correlating the oligomer spectrum with its known long branch, branched chain structure according to the conventional cationic reaction mechanism using the Lindemann and Adams equation (*Anal. Chem.* 43, p. 1245; 1971). This analysis disclosed about 15 to 25 percent more one, two and three carbon branching in the oligomer product prepared by the trickle-through hydrogenation procedure.

In varying hydrogenation conditions we have found that a hydrogen pressure of 600 psi. (42.2 Kg/cm$^2$) and a temperature of 200° C. in both reactors produced substantially more low carbon branching in an oligomer than when it was hydrogenated in the first reactor only at the same conditions and it produced somewhat more branching than the hydrogenation in both reactors at 400 psi. (28.1 Kg/cm$^2$) and 225° C. Two reactors were used herein merely for convenience in order to reduce the individual column height.

It is to be understood that the above disclosure is by way of specific example and that numerous modifications and variations are available to those of ordinary skill in the art without departing from the true spirit and scope of the invention.

We claim:

1. A lubricating oil comprising a hydrogenated mixture of normal 1-decene oligomers having a 210° F. viscosity between about 5.4 cs. and about 6.6 cs. and a −40° F. viscosity of at least about 5,500 cs. and comprising a maximum of about two percent dimer, a trimer to tetramer ratio no higher than about one to one and at least about 15 percent pentamer, and said trimer fraction having a maximum 210° F. viscosity of about 2,250 cs.

2. A lubricating oil in accordance with claim 1 having a 210° F. viscosity between about 5.4 cs. and about 6.3 cs.

3. A lubricating oil in accordance with claim 1 having a 210° F. viscosity between about 5.4 cs. and about 6.0 cs.

4. A lubricating oil in accordance with claim 1 in which the trimer fraction has a maximum −40° F. viscosity of about 2,100 cs.

5. A lubricating oil in accordance with claim 1 in which the said −40° F. viscosity is at least about 6,500 cs.

6. A lubricating oil in accordance with claim 1 in which the said mixture of 1-decene oligomers has an average molecular weight of at least about 500.

* * * * *